US011406181B2

(12) United States Patent
Mulder et al.

(10) Patent No.: US 11,406,181 B2
(45) Date of Patent: Aug. 9, 2022

(54) TABLE INCLUDING WIRE MANAGEMENT POCKETS

(71) Applicant: HERMAN MILLER, INC., Zeeland, MI (US)

(72) Inventors: Craig Charles Mulder, Dorr, MI (US); Brian Stewart Fuller, Acworth, GA (US)

(73) Assignee: MillerKnoll, Inc., Zeeland, MI (US)

( * ) Notice: Subject to any disclaimer, the term of this patent is extended or adjusted under 35 U.S.C. 154(b) by 0 days.

(21) Appl. No.: 17/251,183

(22) PCT Filed: Jun. 11, 2019

(86) PCT No.: PCT/US2019/036466
§ 371 (c)(1),
(2) Date: Dec. 10, 2020

(87) PCT Pub. No.: WO2019/241190
PCT Pub. Date: Dec. 19, 2019

(65) Prior Publication Data

US 2021/0212453 A1 Jul. 15, 2021

Related U.S. Application Data

(60) Provisional application No. 62/683,377, filed on Jun. 11, 2018.

(51) Int. Cl.
*A47B 21/06* (2006.01)

(52) U.S. Cl.
CPC ..... *A47B 21/06* (2013.01); *A47B 2021/062* (2013.01); *A47B 2021/066* (2013.01)

(58) Field of Classification Search
CPC ... A47B 21/00; A47B 21/06; A47B 2021/062; A47B 2021/066; A47B 2200/008
USPC ..... 108/50.01, 50.02, 25, 26; 312/223.6, 312/223.1, 223.2
See application file for complete search history.

(56) References Cited

U.S. PATENT DOCUMENTS

| | | | | |
|---|---|---|---|---|
| 57,209 A | | 8/1866 | Staples | |
| 223,828 A | | 1/1880 | Wiester | |
| 4,535,703 A | | 8/1985 | Henriott et al. | |
| 4,654,756 A | | 3/1987 | Wilson et al. | |
| 4,748,913 A | * | 6/1988 | Favaretto | A47B 17/00 108/50.02 |

(Continued)

FOREIGN PATENT DOCUMENTS

| | | | | |
|---|---|---|---|---|
| EP | 2220963 A2 | | 8/2010 | |
| JP | 2016137166 A | * | 8/2016 | A47B 9/00 |

(Continued)

OTHER PUBLICATIONS

International Search Report with Written Opinion for related Application No. PCT/US2019/036466 dated Aug. 16, 2019 (13 Pages).

*Primary Examiner* — Jose V Chen
(74) *Attorney, Agent, or Firm* — Michael Best & Friedrich LLP

(57) ABSTRACT

A table includes a base defining a wire management pocket and a central area, a power receptacle mounted to the base adjacent the wire management pocket, a leg coupled to the base for supporting the base, and a tabletop supported on the base. The tabletop is slidably removable from the base to provide access to the wire management pocket.

19 Claims, 8 Drawing Sheets

(56) References Cited

U.S. PATENT DOCUMENTS 4,792,881 A 12/1988 Wilson et al.
5,230,552 A 7/1993 Schipper et al.
5,231,562 A 7/1993 Pierce et al.
5,237,935 A 8/1993 Newhouse et al.
5,272,988 A 12/1993 Kelley et al.
5,352,033 A 10/1994 Gresham et al.
5,467,703 A 11/1995 Crinion
5,479,866 A 1/1996 Rae
5,697,686 A * 12/1997 Miller ..... A47B 13/16 108/143
5,709,156 A 1/1998 Gevaert et al.
5,957,062 A 9/1999 Cox et al.
5,971,508 A 10/1999 Deimen et al.
6,003,447 A 12/1999 Cox et al.
6,327,983 B1 1/2001 Cronk et al.
6,202,567 B1 3/2001 Funk et al.
6,254,206 B1 7/2001 Petrick et al.
6,283,043 B1 * 9/2001 Stern ..... A47B 13/06 108/50.02
6,415,723 B1 7/2002 Kopish et al.
6,427,608 B1 8/2002 Crinion
6,435,106 B2 8/2002 Funk et al.
6,564,723 B2 5/2003 Shapton
6,629,505 B1 10/2003 Cronk et al.
6,647,900 B1 11/2003 Kopish
6,848,369 B1 2/2005 King et al.
7,066,097 B2 6/2006 Gayhart et al.
7,111,564 B2 * 9/2006 Chang ..... A47B 13/06 108/155
7,191,713 B2 3/2007 Gayhart et al.
7,703,398 B2 * 4/2010 Brauning ..... A47B 1/08 108/50.02
7,765,937 B2 * 8/2010 Weissenrieder ..... A47B 13/021 108/50.02
7,779,762 B2 8/2010 Sackman
7,871,280 B2 1/2011 Henriott
7,926,430 B2 4/2011 Bakker et al.
7,966,951 B1 * 6/2011 Black ..... H02G 3/128 108/50.02
7,997,212 B2 8/2011 Henriott
8,051,783 B1 11/2011 Hoskinson
8,082,856 B1 12/2011 Hayden et al.
8,689,705 B2 * 4/2014 Martin ..... A47B 21/06 108/50.02
8,925,469 B2 1/2015 Bennie et al.
8,967,054 B2 * 3/2015 Henriott ..... A47B 81/002 108/50.02
9,271,568 B2 3/2016 Schiavello et al.
9,706,840 B2 * 7/2017 Tsuchiyama ..... A47B 21/00
9,723,919 B1 8/2017 Randolph et al.
2003/0070595 A1 4/2003 Crinion
2003/0089283 A1 * 5/2003 Okamoto ..... A47B 17/02 108/50.02
2005/0263042 A1 12/2005 Martin et al.
2005/0268823 A1 12/2005 Bakker et al.
2005/0284341 A1 * 12/2005 Klassy ..... A47B 21/00 108/50.02
2006/0096506 A1 * 5/2006 Brauning ..... A47B 13/02 108/50.02
2008/0295745 A1 * 12/2008 Hamilton ..... A47B 13/06 108/50.02
2009/0165680 A1 7/2009 Bkker et al.
2009/0273260 A1 * 11/2009 Kemp ..... A47B 21/06 312/223.3
2009/0284655 A1 11/2009 Lukes
2009/0293773 A1 * 12/2009 Miller ..... A47B 21/00 108/28
2010/0116175 A1 * 5/2010 Pellegrini ..... A47B 37/00 108/50.02
2011/0155023 A1 6/2011 Krause et al.
2013/0061783 A1 * 3/2013 Bennie ..... H02G 3/14 108/25
2015/0245707 A1 9/2015 Saab
2015/0289642 A1 10/2015 Mirth et al.
2018/0110327 A1 * 4/2018 Keller ..... H02G 3/0691
2018/0338608 A1 * 11/2018 Keller ..... A47B 9/20
2019/0069669 A1 * 3/2019 Hall ..... A47B 21/06

FOREIGN PATENT DOCUMENTS

WO WO97/46139 A 12/1997
WO WO2013/093658 A1 6/2013
WO WO2014/122503 A1 8/2014

* cited by examiner

TABLE INCLUDING WIRE MANAGEMENT POCKETS

CROSS-REFERENCE TO RELATED APPLICATION

This application claims priority to U.S. Provisional Application No. 62/683,377, filed Jun. 11, 2018, the entire contents of which are incorporated herein by reference.

FIELD OF THE INVENTION

The present invention relates to tables and, more particularly, to conference tables having wire management pockets for integrated power receptacles.

SUMMARY

In one embodiment, the invention provides a table including a base defining a wire management pocket and a central area, a power receptacle mounted to the base adjacent the wire management pocket, a leg coupled to the base for supporting the base, and a tabletop removably coupled to the base. The tabletop is slidably removable from the base to provide access to the wire management pocket.

In another embodiment, the invention provides a table including a base having a plurality of separating structures defining a plurality of wire management pockets, a plurality of power receptacles each mounted to the base adjacent one of the plurality of wire management pockets, a leg coupled to the base for supporting the base, and a tabletop removably coupled to the base. The tabletop is removable from the base without the use of tools to provide access to the wire management pocket.

In another embodiment, the invention provides a table including a base defining a wire management pocket, a power receptacle mounted to the base adjacent the wire management pocket, a leg coupled to the base for supporting the base, and a tabletop supported on the base. The tabletop is movable relative to the base between a first position, in which the tabletop covers the wire management pocket and is secured to the base, and a second position, in whith the tabletop covers the wire management pocket and is removable from the base.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
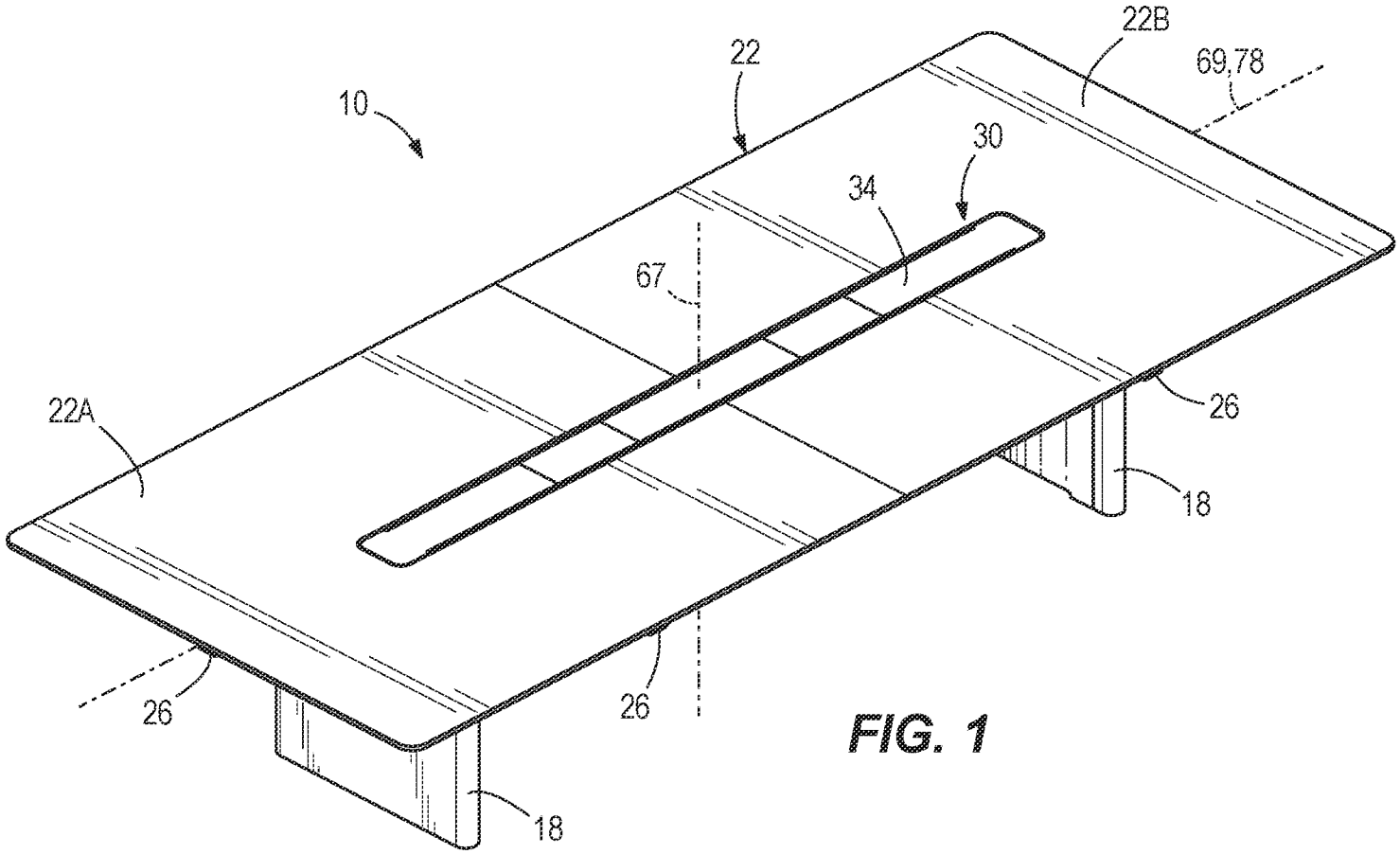
FIG. 1 is a top perspective view of a table embodying the invention, the table including a tabletop in a secured position.
Figure 2:
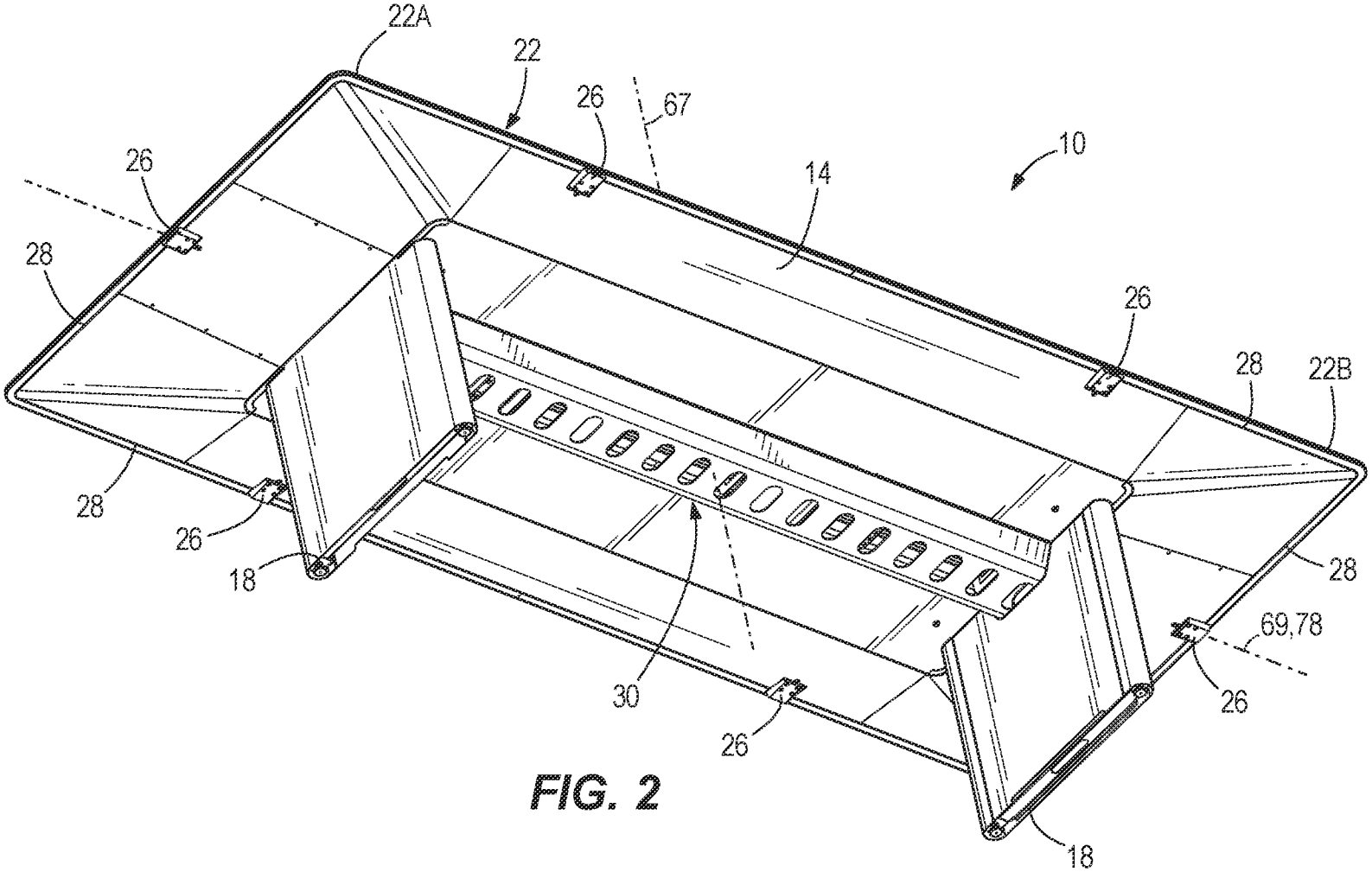
FIG. 2 is a bottom perspective view of the table.

FIGS. 1-2 illustrate a table 10. The illustrated table 10 is a relatively large rectangular table suitable for use in, for example, a conference room. The table 10 allows multiple people to be seated around the table 10 simultaneously. In other embodiments, the table 10 may be configured for other uses, such as personal use for a single person (e.g., a desk). Additionally or alternatively, the table 10 may be other shapes (e.g., round, square, oblong, hexagonal, irregular, etc.) and/or may have other dimensions.

The table 10 includes a base 14, a plurality of legs 18 coupled to the base 14 for supporting the base 14 above the floor, and a tabletop 22 positioned on top of the base 14 so that the tabletop is supported by the base 14. In the illustrated embodiment, the table 10 also includes a plurality of power receptacles 26 mounted to the base 14. As shown in FIG. 2, the power receptacles 26 are positioned at an edge 28 of the base 14, underneath the tabletop 22. The power receptacles 26 provide outlets (e.g., USB outlets, three-prong outlets, etc.) for plugging in and powering/charging external devices (e.g., phones, laptop computers, tablet computers, etc.). In the illustrated embodiment, the table 10 includes six power receptacles 26 spaced apart around the table 10, Two power receptacles 26 are positioned on each side of the table 10, and one power receptacle 26 is positioned at each end of the table 10. In other embodiments, the table 10 may include fewer or more power receptacles 26, depending on the size of the table 10.

Figure 8:
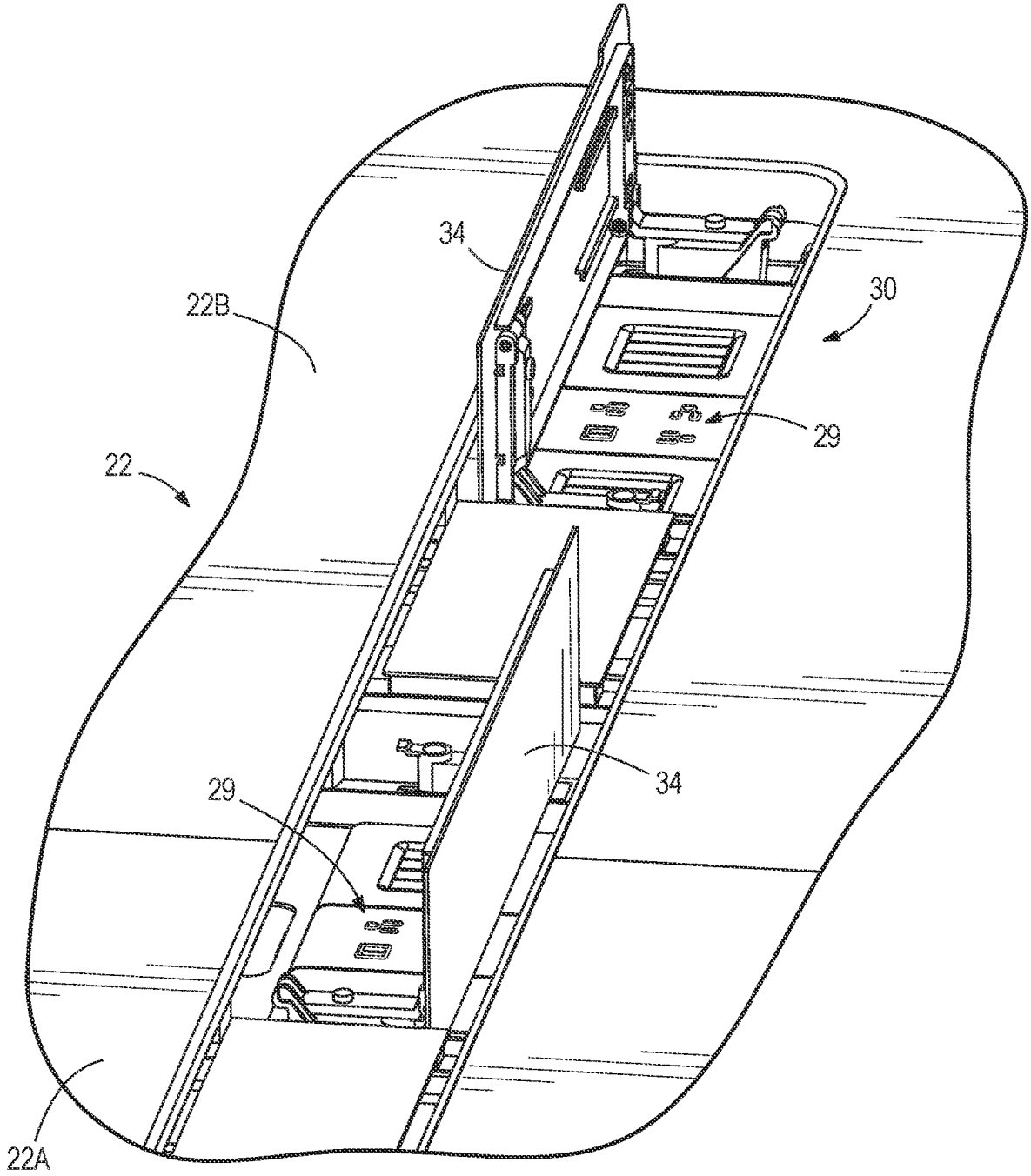
FIG. 8 is an enlarged perspective view of a central area of the table.

As shown in FIG. 8, the illustrated table 10 further includes power receptacles 29 located in a central area 30 defined in the base 14, The power receptacles 29 are covered by one or more power access doors 34 (FIG. 1), which provide a relatively continuous aesthetic with the tabletop 22. The power access doors 34 are selectively openable to provide access to the power receptacles in the central area 30.

Figure 3:
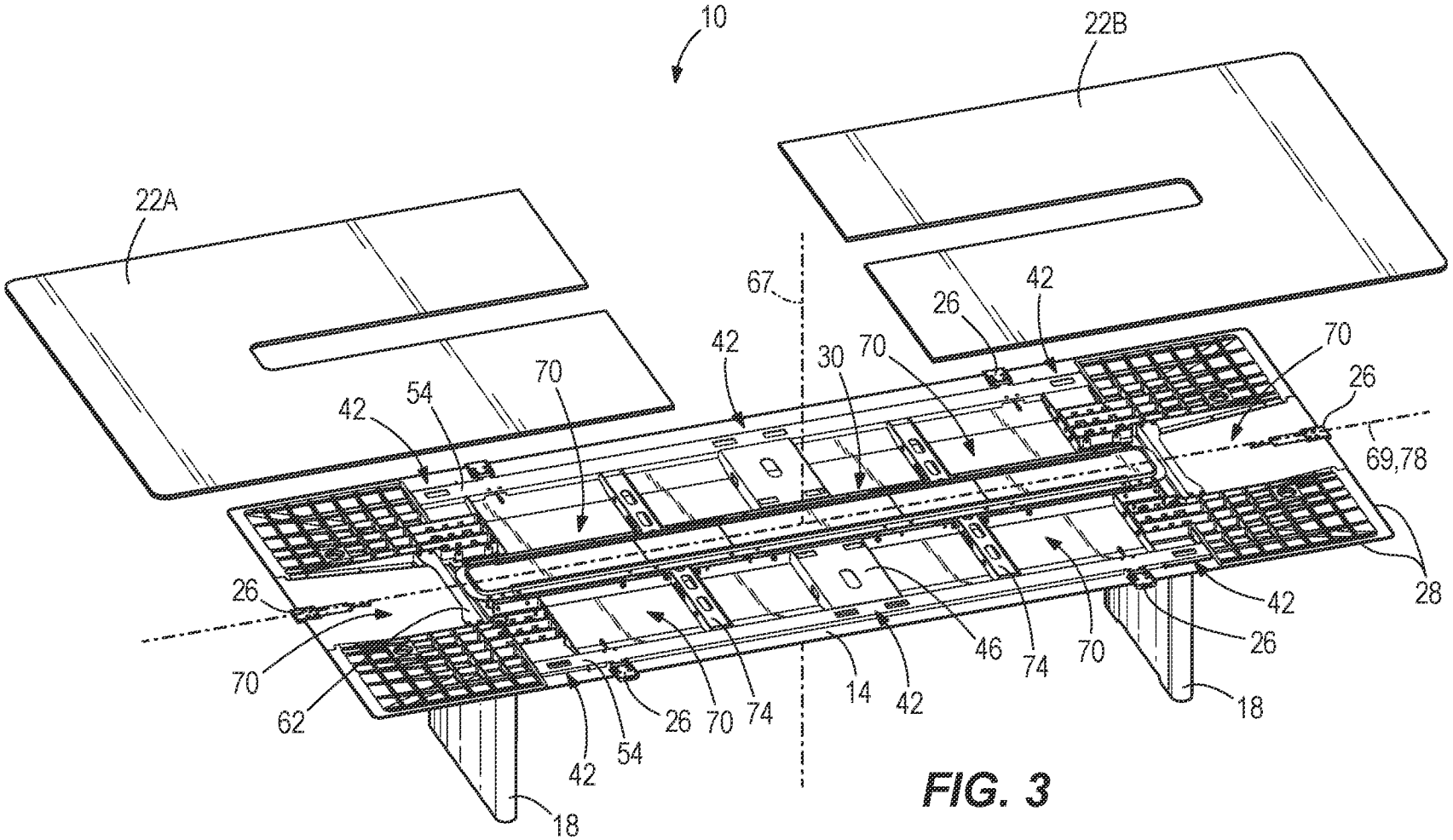
FIG. 3 is a top perspective view of the table with the tabletop lifted away.
Figure 4:
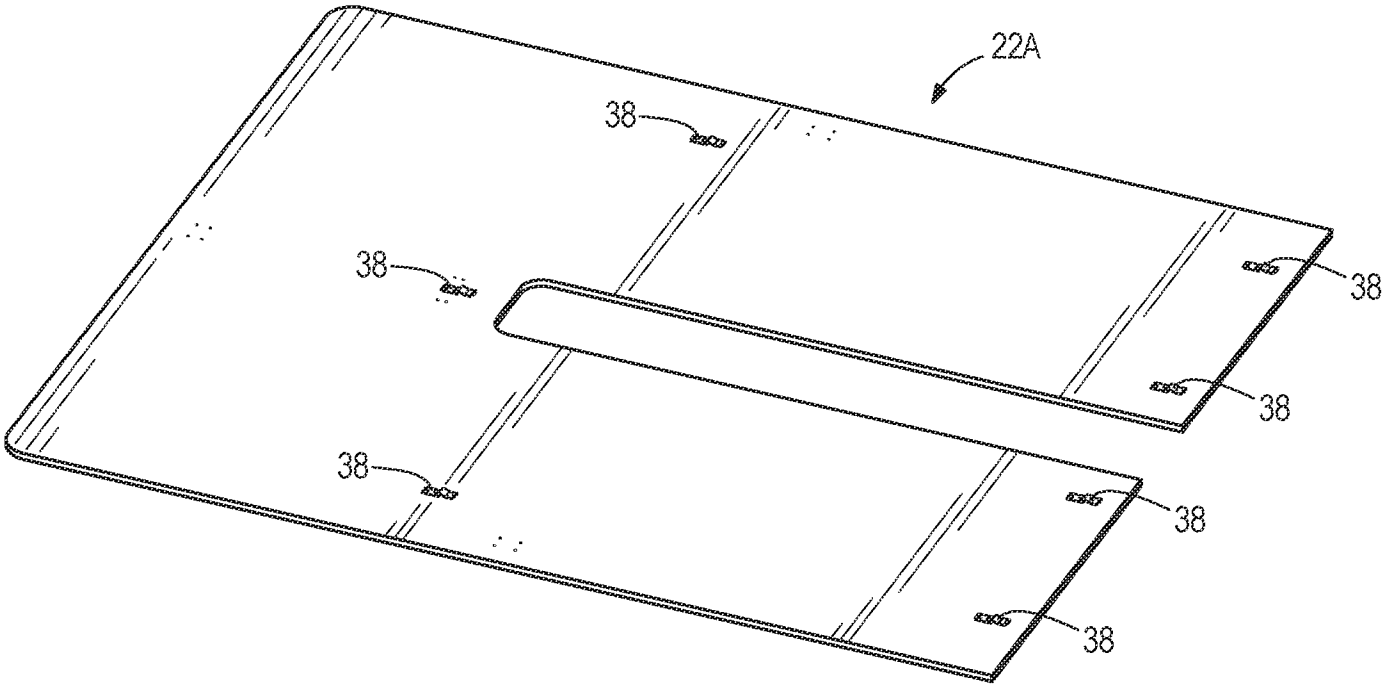
FIG. 4 is a bottom perspective view of a portion of the tabletop.

As shown in FIG. 3, the tabletop 22 is removably coupled to the base 14. More specifically, the tabletop 22 is slidably removable from the base 14. Additionally, the tabletop 22 is removably coupled to the base 14 without tools (e.g., without requiring a user to use a screwdriver, Allen wrench, socket, or other tool to unsecure the tabletop 22 from the base 14). In the illustrated embodiment, the tabletop 22 is formed of two pieces 22A, 22B. In this embodiment, each piece 22A, 22B is separately slidably removable from the base 14. In other embodiments, the tabletop 22 may be formed from a single piece. Additionally, the tabletop 22 may be composed of wood, stone, metal, glass, composites, or other suitable materials.

Figure 5:
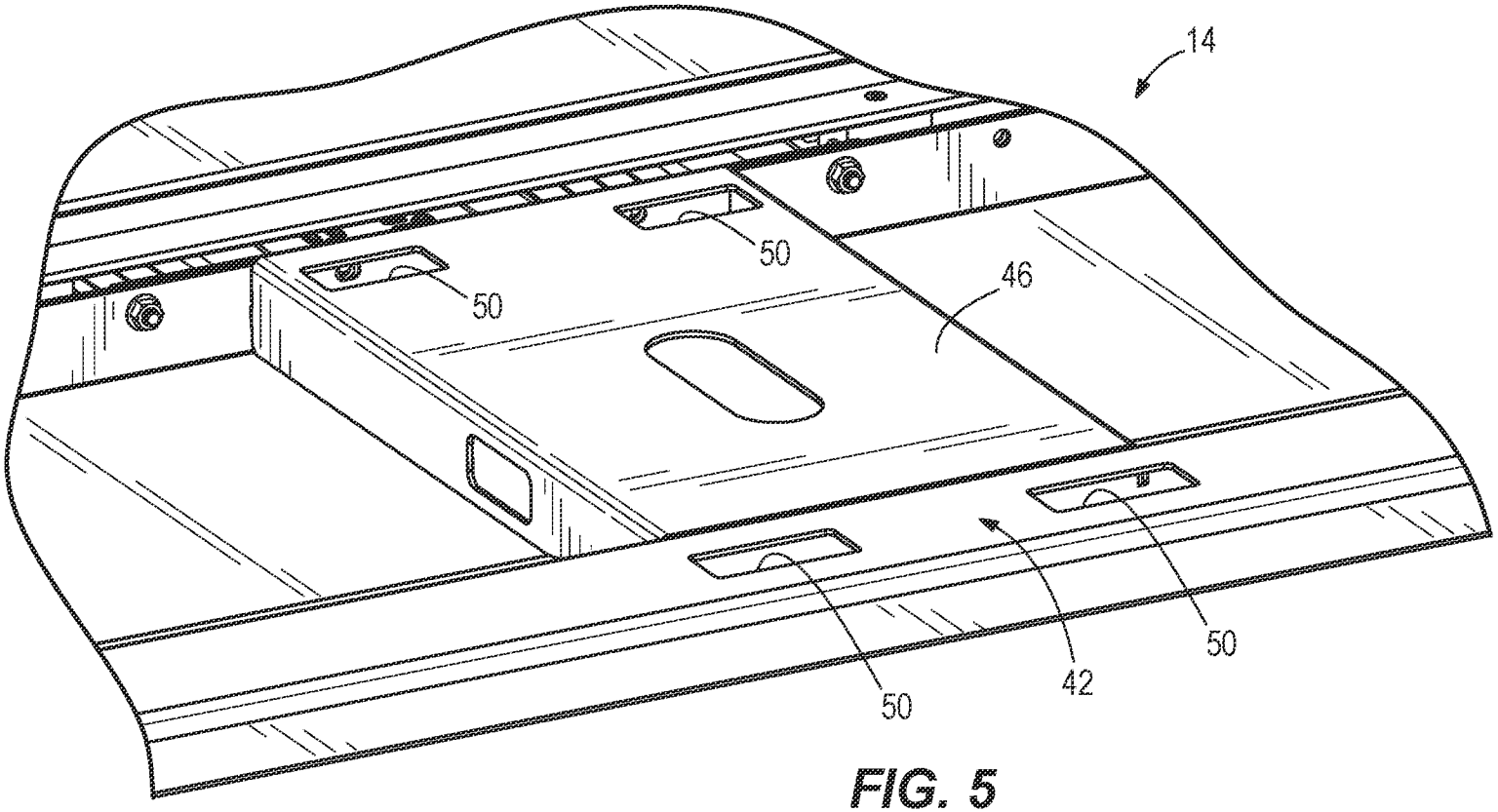
FIG. 5 is an enlarged view of a portion of the table.

FIG. 5 illustrates an underside of one of the pieces 22A of the tabletop 22. The other piece 22B of the tabletop 22 is substantially the same. The tabletop 22 includes mounting clips 38 for securing the tabletop 22 to the base 14. In the illustrated embodiment, the piece 22A of the tabletop 22 includes seven mounting clips 38 spaced apart on the underside of the tabletop 22. In other embodiments, the piece 22A of the tabletop 22 may include fewer or more mounting clips 38. Each mounting clip 38 is generally formed as a cantilevered spring that can releasably grasp a portion of the base 14. In other embodiments, the tabletop 22 may include other suitable mounting means for releasably securing the tabletop 22 to the base 14.

Figure 6:
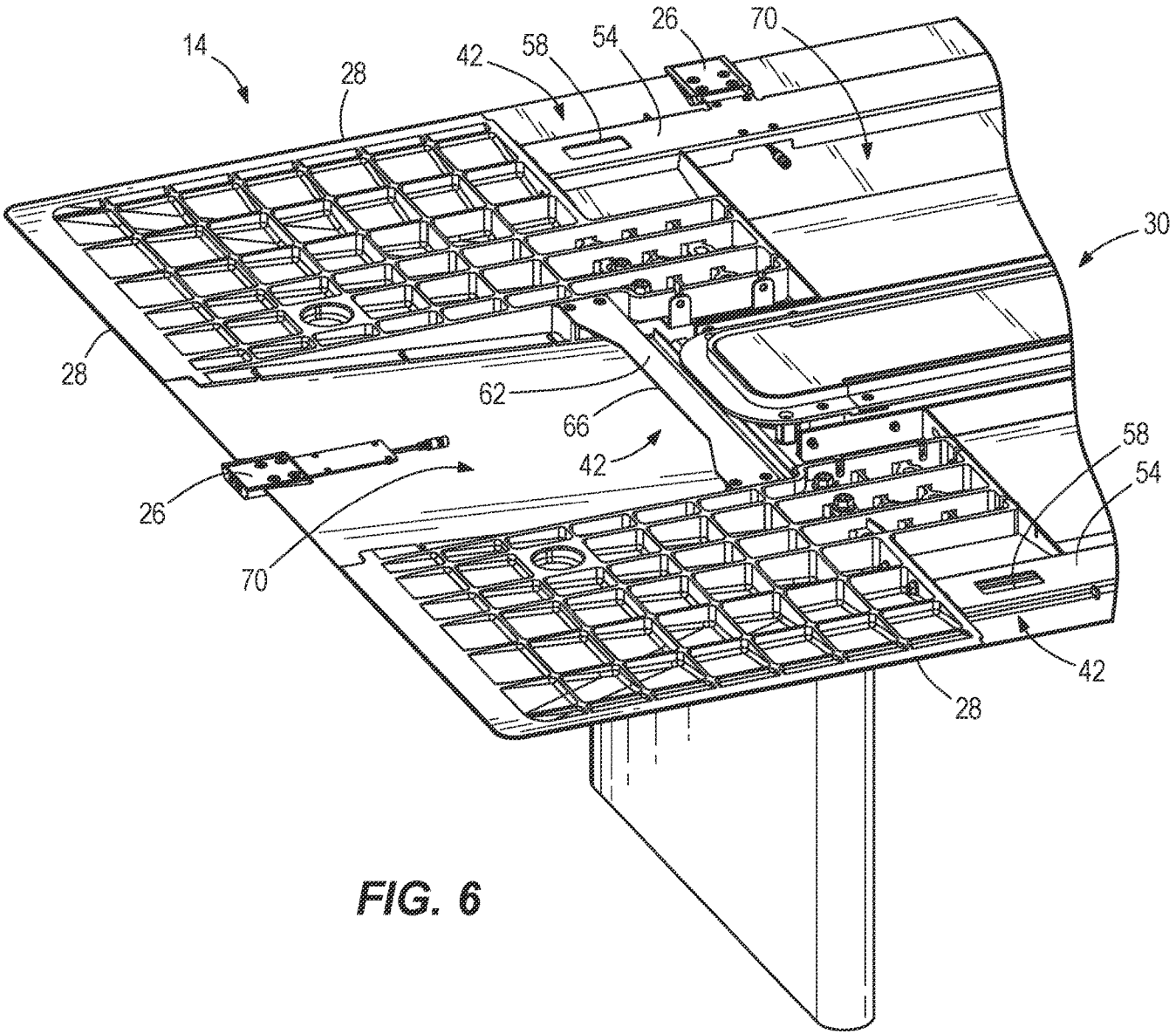
FIG. 6 is an enlarged view of another portion of the table.
Figure 7:
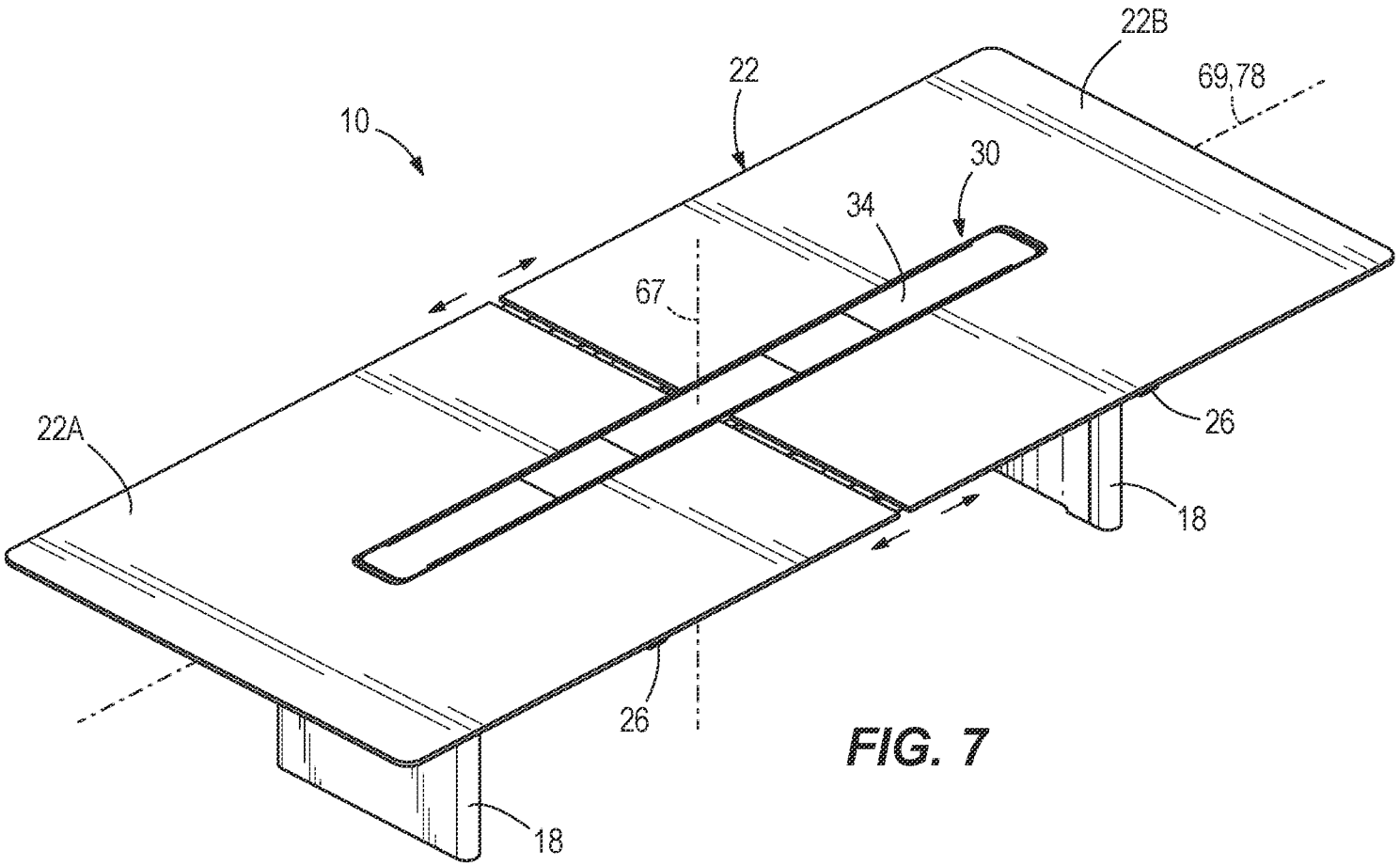
FIG. 7 is a top perspective view of the table with the tabletop moved to an unsecured position.

As shown in FIGS. 5 and 6, the base 14 includes mounting areas 42 configured to be engaged by the mounting clips 38 of the tabletop 22. For example, as shown in FIG. 5, a bracket 46 located toward the middle of the base 14 includes four openings 50 that can receive mounting clips 38. Two of the openings 50 receive two mounting clips 38 for one piece 22A of the tabletop 22, and the other two openings 50 receive two mounting clips 38 from the other piece 22B of the tabletop 22, A similar bracket with openings is aligned with the bracket 46 on the other side of the central area 30. As shown in FIG. 6, brackets 54 located toward the end of the base 14 each include an opening 58 that can receive mounting clips 38, In addition, a bracket 62 adjacent the power access door 34 includes a cantilevered edge 66 that can be engaged by one of the mounting clips 38. In other embodiments, the base 14 may include mounting areas 42 located or formed in different structures 74 of the base 14. In some embodiments, the base 14 may include the mounting clips 38 and the tabletop 22 may include the mounting areas 42 configured to engage the mounting clips 38.

To connect the tabletop 22 to the base 14, the mounting clips 38 are aligned with the mounting areas 42 on the base 14, and the tabletop 22 is lowered along a lifting axis 67 to be supported on the base 14 in an unsecured position. Once the mounting clips 38 are positioned in the corresponding openings 50, 58, the tabletop 22 is slid a small amount relative to the base 14 along a sliding axis 69 so the mounting clips 38 engage edges of the brackets 46, 54 defining the openings 50, 58 (or the cantilevered edge 66 of the bracket 62). The tabletop 22 is then releasably secured to the base 14 in a secured position. Since the tabletop 22 is split into two pieces 22A, 22B, each piece 22A, 22B can be independently coupled to the base 14 in a similar manner, albeit at opposite ends of the table 10. The two pieces 22A, 22B of the tabletop 22 are slid toward each other to engage the mounting clips 38 with the corresponding mounting areas 42 on the base 14.

To remove the tabletop 22 from the base 14, the tabletop 22 is slid a small amount relative to the base 14 along the sliding axis 69 so the mounting clips 38 disengage the edges of the brackets 46, 54 (or the cantilevered edge 66 of the bracket 62). The tabletop 22 is released from being secured to the base 14 in the secured position and is slid until the mounting clips 38 are aligned with the corresponding openings 50, 58 so that the tabletop 22 is in the unsecured position. The tabletop 22 is lifted along the lifting axis 67 to be removed from the base 14. In this embodiment, the lifting axis 67 is generally perpendicular to the sliding axis 69. In other embodiments, the lifting axis 67 may be positioned at a different angle to the sliding axis 69, or may be parallel to the sliding axis 69.

Referring back to FIG. 3, the base 14 defines a plurality of pockets 70. Each pocket 70 corresponds to and is adjacent one of the power receptacles 26. The pockets 70 provide storage areas for cables or wires connected to the power receptacles 26 and can be referred to as wire management pockets. In particular, the pockets 70 provide a void underneath the tabletop 22 to fit extra lengths of cables extending from the central area 30 of the table 10 (which is connected to a building's power supply) to the power receptacles 26 located at the edge 28 of the table 10. In the illustrated embodiment, the pockets 70 are separated by structures 74 (e.g., brackets, moldings, etc.) of the base 14 so that each power receptacle 26 is associated with a discrete pocket 70. Such an arrangement reduces confusion regarding which cables are associated with which power receptacles 26. In other embodiments, multiple power receptacles 26 may be associated with the same pocket.

In some embodiments, pockets are located on a first side of a longitudinal axis 78 running through the central area 30, and pockets are located on an opposite side of the longitudinal axis 78 running through the central area 30. The central area 30 in these embodiments acts as a shared structure 74 for separating the pockets 70 located on the first side of the longitudinal axis 78 from the pockets 70 on the opposite side of the longitudinal axis 78.

Additionally, the pockets 70 can be used to store electrical componentry used for collaboration within a meeting place setting. For example, routers, sharing hubs, data controllers, and the like may be stored within the pockets 70 and also connected to the cables.

The pockets 70 are covered by the tabletop 22 when the tabletop 22 is supported on the base 14, but the pockets 70 are easily accessible by removing the tabletop 22 from the base 14, as explained above, Such an arrangement allows the power receptacles 26 and associated cables to be accessed from above the table 10, rather than below the table, for initial installation, maintenance, and/or replacement. In addition, as shown in FIG. 2, cables are not visible underneath the table 10, providing a cleaner aesthetic with no visible wires or fasteners holding cables, and reducing the possibility of a user seated at the table 10 snagging or pulling on the cables.

Various features and advantages of the invention are set forth in the following claims.

What is claimed is:

1. A table comprising:

a base defining a wire management pocket and a central area;

a power receptacle mounted to the base adjacent the wire management pocket;

a leg coupled to the base for supporting the base; and a tabletop supported on the base, the tabletop being horizontally slidable along the base between a secured position, in which the tabletop is secured to the base, and an unsecured position, in which the tabletop is removable from the base, to provide access to the wire management pocket.

2. The table of claim 1, wherein one of the tabletop or the base includes a mounting clip for securing the tabletop to the base, wherein another of the tabletop or the base includes a bracket for engaging the mounting clip.

3. The table of claim 2, wherein the bracket defines an opening that receives the mounting clip.

4. The table of claim 2, wherein the bracket has a cantilevered edge that engages the mounting clip.

5. The table of claim 2, wherein the mounting clip is a first mounting clip and the bracket is a first bracket, wherein the one of the tabletop or the base includes a second mounting clip, wherein the another of the tabletop or the base includes a second bracket for engaging the second mounting clip, and wherein the first and second brackets are located on opposite sides of the central area of the base.

6. The table of claim 5, wherein the one of the tabletop or the base includes a third mounting clip, wherein the another of the tabletop or the base includes a third bracket for engaging the third mounting clip, and wherein the third bracket is located toward an end of the base.

7. The table of claim 1, wherein the tabletop includes a first piece and a second piece, and wherein each piece is independently removable from the base.

8. The table of claim 1, wherein the power receptacle is mounted to an edge of the base underneath the tabletop.

9. The table of claim 1, wherein the central area of the base houses power receptacles covered by a power access door.

10. The table of claim 1, wherein the tabletop covers the wire management pocket when the tabletop is supported on the base.

11. The table of claim 1, wherein when the tabletop is in the unsecured position, the tabletop is liftable away from the base.

12. The table of claim 1, wherein the base has a plurality of separating structures defining a plurality of wire management pockets, wherein the table further comprises a plurality of power receptacles, and wherein each power receptacle is mounted to the base adjacent one of the plurality of wire management pockets.

13. The table of claim 1, wherein the wire management pocket is configured to store a cable connected to the power receptacle.

14. A table comprising:

a base having a plurality of separating structures, the plurality of separating structures defining a plurality of wire management pockets;

a plurality of power receptacles, each power receptacle mounted to the base adjacent one of the plurality of wire management pockets;

a leg coupled to the base for supporting the base;

a tabletop removably coupled to the base; and a mounting bracket for coupling the tabletop to the base when the mounting bracket is in an engaged position, wherein the mounting bracket is movable to a disengaged position to allow the tabletop to be removed from the base without the use of tools to provide access to the plurality of wire management pockets.

15. The table of claim 14, wherein the tabletop is slidable along the base and liftable away from the base to remove the tabletop from the base.

16. The table of claim 14, wherein the tabletop includes a mounting clip for securing the tabletop to the base, and wherein the base includes a bracket for engaging the mounting clip.

17. The table of claim 14, wherein the base includes a central area that houses power receptacles, wherein the central area is one of the plurality of separating structures such that a first wire management pocket is located on a first side of the central area and a second wire management pocket is located on a second side of the central area.

18. A table comprising:

a base defining a wire management pocket;

a power receptacle mounted to the base adjacent the wire management pocket;

a leg coupled to the base for supporting the base; and a tabletop supported on the base, the tabletop being movable horizontally along the base between a first position, in which the tabletop covers the wire management pocket and is secured to the base, and a second position, in which the tabletop covers the wire management pocket and is removable from the base, wherein the tabletop is supported on the base in both the first position and the second position.

19. The table of claim 18, wherein the tabletop is slidable relative to the base.

* * * * *